US011499690B2

(12) United States Patent
Paroni et al.

(10) Patent No.: US 11,499,690 B2
(45) Date of Patent: Nov. 15, 2022

(54) AUTOMOTIVE LIGHTING AND/OR SIGNALING DEVICE

(71) Applicant: MARELLI AUTOMOTIVE LIGHTING ITALY S.p.A., Venaria Reale (IT)

(72) Inventors: Sara Paroni, Tolmezzo (IT); Sandro Tolusso, Tolmezzo (IT); Pierfrancesco Zilio, Tolmezzo (IT)

(73) Assignee: MARELLI AUTOMOTIVE LIGHTING ITALY S.p.A., Venaria Reale (IT)

( * ) Notice: Subject to any disclaimer, the term of this patent is extended or adjusted under 35 U.S.C. 154(b) by 0 days.

(21) Appl. No.: 17/124,304

(22) Filed: Dec. 16, 2020

(65) Prior Publication Data

US 2021/0190284 A1 Jun. 24, 2021

(30) Foreign Application Priority Data

Dec. 18, 2019 (EP) ..... 19425093

(51) Int. Cl.
*F21S 41/26* (2018.01)
*F21S 41/29* (2018.01)
(Continued)

(52) U.S. Cl.
CPC ..... *F21S 41/26* (2018.01); *F21S 41/143* (2018.01); *F21S 41/295* (2018.01); *F21S 41/36* (2018.01); *F21S 41/39* (2018.01); *F21Y 2115/10* (2016.08)

(58) Field of Classification Search
CPC .. F21S 41/26; F21S 41/36; F21S 41/39; F21S 41/143; F21S 41/295; B60Q 1/0041; B60Q 1/02; B60Q 1/20
See application file for complete search history.

(56) References Cited

U.S. PATENT DOCUMENTS

2014/0160779 A1 6/2014 Pusch et al.

FOREIGN PATENT DOCUMENTS

EP 3096072 A1 11/2016
FR 3074563 A1 6/2019
(Continued)

OTHER PUBLICATIONS

Communication dated May 13, 2020 transmitting the Extended European Search Report dated Apr. 30, 2020 for European Application No. 19425093.

*Primary Examiner* — Karabi Guharay
(74) *Attorney, Agent, or Firm* — Howard & Howard Attorneys PLLC

(57) ABSTRACT

A lighting and/or signaling device comprising a container body which delimits a containment seat that houses a first luminous source adapted to emit a first luminous beam, and a second luminous source adapted to emit a second luminous beam. The containment seat adapted to be at least partially crossed by the luminous beams produced by said luminous sources, so as to transmit the luminous beams outside the containment seat. The containment seat is divided into a first compartment which houses the first luminous source and into a second compartment which houses the second luminous source. The lenticular body comprises a first transmission portion, facing the first compartment that transmits, at least partially, towards the outside the first luminous beam, a second transmission portion facing the second compartment that transmits, at least partially, towards the outside the second luminous beam. An opaque portion, is interposed between the first and second transmission portions so as to conceal the view of the first and second luminous sources.

16 Claims, 3 Drawing Sheets

(51) Int. Cl.

| | |
|---|---|
| ***F21S 41/36*** | (2018.01) |
| ***F21S 41/143*** | (2018.01) |
| ***F21S 41/39*** | (2018.01) |
| *F21Y 115/10* | (2016.01) |

(56) References Cited

FOREIGN PATENT DOCUMENTS

| | | | |
|---|---|---|---|
| FR | 3082153 | A1 | 12/2019 |
| WO | 2012120441 | A1 | 9/2012 |
| WO | 2014135762 | A1 | 9/2014 |

AUTOMOTIVE LIGHTING AND/OR SIGNALING DEVICE

CROSS-REFERENCE TO RELATED APPLICATIONS

The present application claims priority to and all the benefits of European Patent Application No. 19425093.2, filed on Dec. 18, 2019, which is hereby expressly incorporated herein by reference in its entirety.

BACKGROUND OF THE INVENTION

1. Field of the Invention

The present invention relates to an automotive lighting and/or signaling device.

2. Description of the Related Art

The term automotive lighting and/or signaling device is used herein in a very broad meaning, so as to comprise both a rear and a front automotive lamp, the latter also being called headlight or headlamp.

Therefore, a position light, a direction indicator light, a stop light, a rear fog light, a reversing light, a dipped-beam headlamp, a high-beam headlamp and the like, are included.

Furthermore, the term is also meant to comprise a map light, a light for a dashboard or part thereof; therefore, the automotive lighting and/or signaling device may be located both inside and outside the vehicle.

As known, automotive lighting and/or signaling devices may be used both for lighting and for sending visual signals.

To this end, these devices comprise a plurality of illuminating portions having different colors, different levels of brightness (also according to regulations to be complied with) and the like.

In particular, in recent years, lighting and/or signaling devices have increasingly acquired an aesthetic value as well as a photometric function. In other words, apart from, of course, the lighting and/or signaling function which they must carry out, the lighting and/or signaling devices are increasingly used as design elements within the context of the vehicle in which they are inserted.

To this end, providing lighting and/or signaling devices which have illuminating portions having particular drawings and/or geometries and/or writings or symbols, as required by vehicle manufacturers, is known.

To obtain automotive lighting and/or signaling devices which satisfy such requests, providing devices with multiple luminous sources and multiple lenticular bodies equipped with masks and colored portions is known. The colored portions have the function of carrying out both photometric functions as well as aesthetic functions; the masks are used to conceal the presence of the internal components of the lamp from the outside and to delimit the different lighting areas which are to be obtained.

Such solutions imply the realization of many components of the lamp which must be suitably assembled together: the result is a lighting and/or signaling device which is expensive and complex to make, as well as relatively heavy and bulky.

SUMMARY OF THE INVENTION

The need is therefore felt in the background art to provide an automotive lighting and/or signaling device which allows to obtain the above mentioned technical effects, with an excellent aesthetic result, both in terms of precision of the illuminating portions as well as in terms of lighting homogeneity, without implying excessive construction and assembly costs, and limiting weight and size.

Such requirement is met by an automotive lighting and/or signaling device comprising a container body which delimits a containment seat closed by a lenticular body. The containment seat houses a first luminous source adapted to emit a first luminous beam, and a second luminous source adapted to emit a second luminous beam. The containment seat is closed by a lenticular body and adapted to be at least partially crossed by the luminous beams produced by the luminous sources, so as to transmit the luminous beams outside of the containment seat. The containment seat is divided into a first compartment which houses the first luminous source and a second compartment which houses the second luminous source. The first compartment and second compartment are separated by at least one separation wall. The lenticular body comprises a first transmission portion, facing the first compartment that transmits, at least partially, the first luminous beam towards the outside, a second transmission portion, facing the second compartment that transmits, at least partially, the second luminous beam towards the outside. An opaque portion is interposed between the first transmission portion and second transmission portion so as to conceal the view of the first luminous source and second luminous source from the outside.

Other embodiments of the present invention are described in the dependent claims.

BRIEF DESCRIPTION OF THE DRAWINGS

Further features and advantages of the present invention will become more apparent from the following description of preferred and non-limitative embodiments thereof, in which.

The common elements or parts of elements between the embodiments described below will be indicated with the same reference numerals.

DETAILED DESCRIPTION OF THE INVENTION

Figure 1:
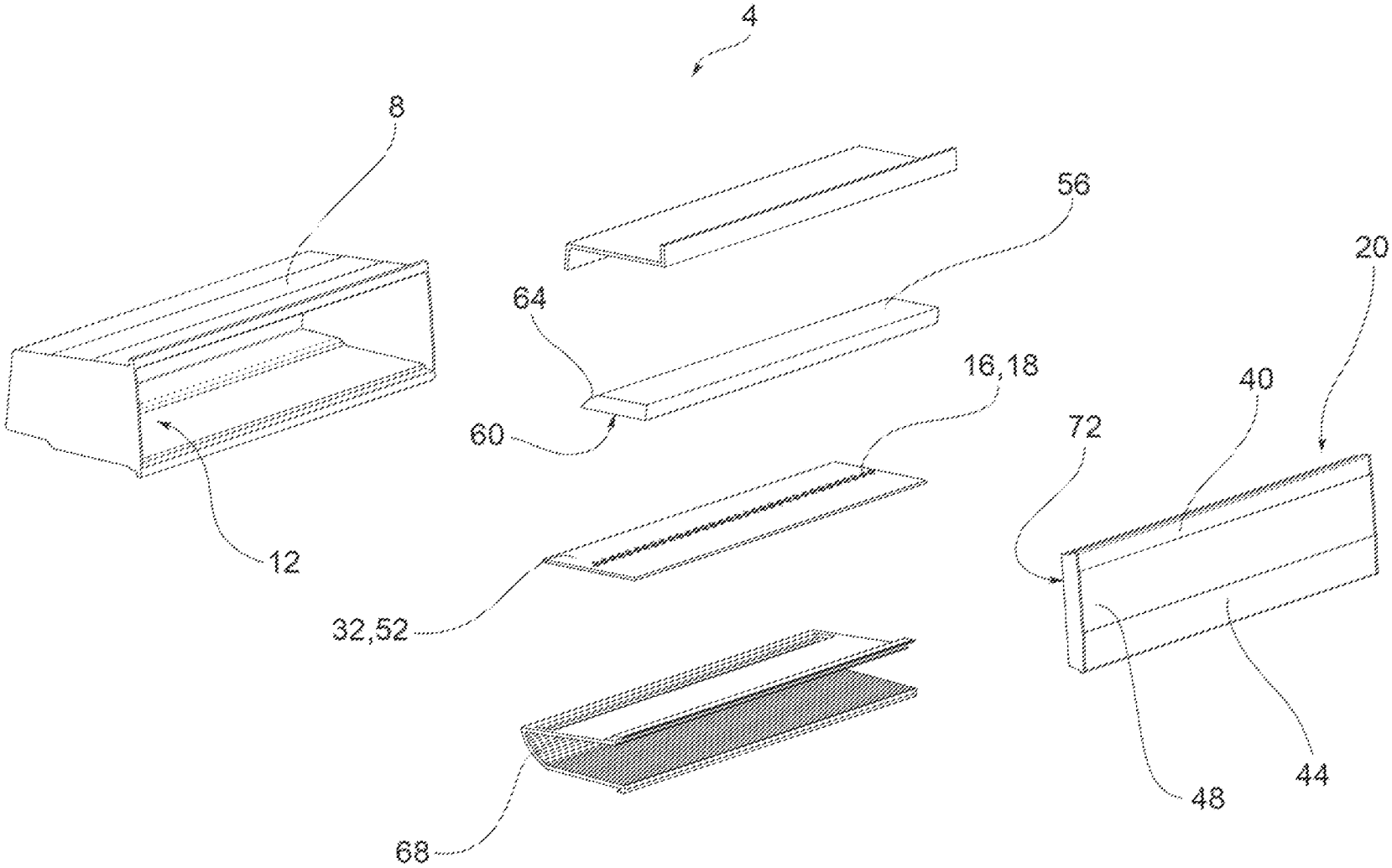
FIG. 1 shows a perspective view, with separate parts, of a lighting and/or signaling device according to an embodiment of the present invention.
Figure 2:
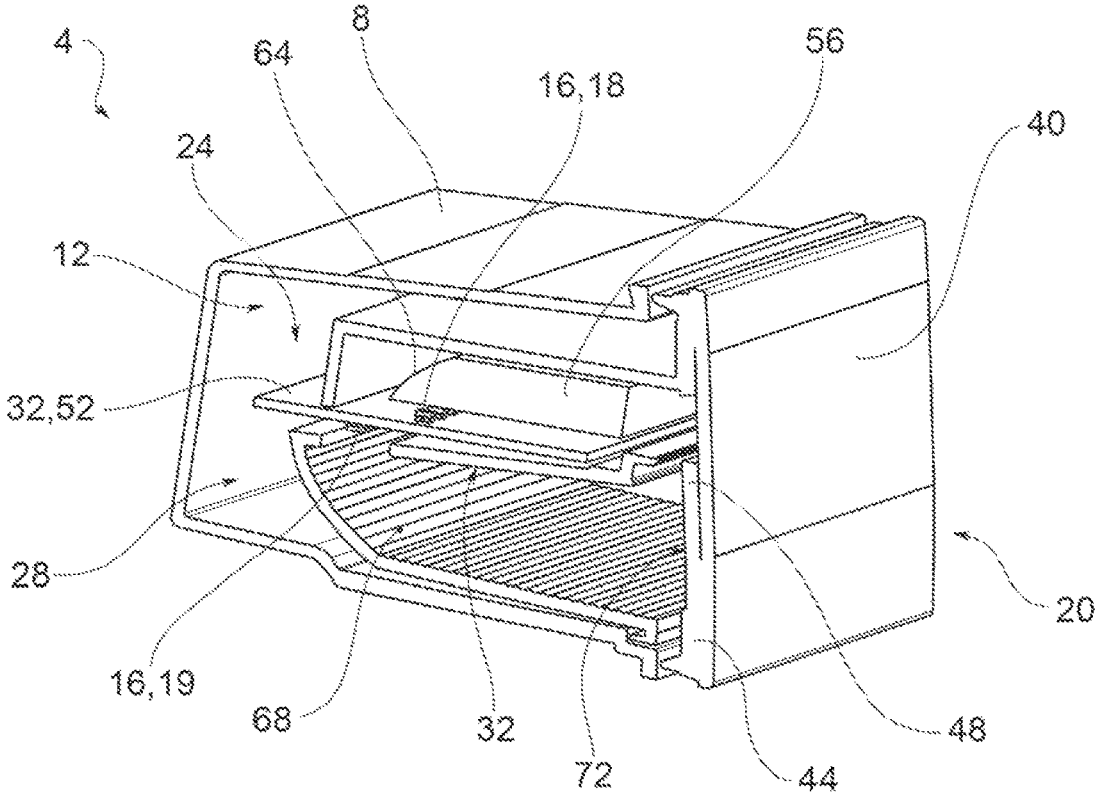
FIG. 2 shows a sectional perspective view, with separate parts, of the lighting and/or signaling device of FIG. 1.

With reference to the aforesaid figures, reference numeral 4 generally indicates a lighting and/or signaling device, such as an automotive lamp, to which the following description will refer without this implying any loss of generality.

As mentioned above, the term lighting and/or signaling device generally refers to an automotive rear lamp or an automotive front lamp, the latter also called headlight or headlamp, comprising an external vehicle light having a lighting and/or signaling function, such as, for example, a position light, which may be a front, rear, side position light, a direction indicator light, a stop light, a rear fog light, a high-beam headlamp, a dipped-beam headlamp and the like.

Furthermore, the term lighting and/or signaling device also refers to an inside map light, a light for a dashboard or part thereof, a display and so on.

Therefore, as better described below, in the signaling function thereof, the device may comprise the possibility of sending luminous signals, logos, but also luminous messages and writings of any kind.

The lighting and/or signaling device 4 comprises a container body or housing 8, usually made of a polymeric material, which conventionally allows the lighting and/or signaling device 4 to be fastened to the relative vehicle or to any type of support.

For the purposes of the present invention, the container body or housing 8 may have any shape and size, as well as positioning: for example, the container body 8 may not be directly associated with the bodywork or other external fixings of the associated vehicle.

As seen, the container body 8 may also be internally associated with the vehicle, for example, on the instrument panel, on the dashboard, on the parcel shelf and so on.

The container body 8 delimits a containment seat 12 which houses a plurality of components of said lighting and/or signaling device.

In particular, the containment seat 12 houses a plurality of luminous sources 16, preferably LED luminous sources or laser luminous sources, arranged and supported inside said containment seat 12.

For example, a lenticular body 20 may be associated with the container body 8, as an at least partial closure, so as to close said containment seat 12 which houses the at least one luminous source 16.

For the purposes of the present invention, the lenticular body 20 may be external to the lighting and/or signaling device 4, so as to define at least one external wall of the lighting and/or signaling device directly subject to the atmosphere.

According to possible embodiments, the material of the lenticular body 20 is a resin such as PMMA (Polymethyl methacrylate), PC (polycarbonate) and the like.

The lenticular body 20 closes the containment seat 12 and is adapted to be at least partially crossed by the luminous beam produced by the luminous sources 16, which is transmitted outside the containment seat 12, as better described below.

In this regard, the lenticular body 20 is made of an at least partially transparent or semitransparent or translucent material, which may also comprise one or more opaque portions, so as to allow, in any case, the at least partial crossing of the luminous beam produced by the luminous source.

The containment seat 12 houses a first luminous source 18 adapted to emit a first luminous beam, and a second luminous source 19 adapted to emit a second luminous beam.

Advantageously, the containment seat 12 is divided into a first compartment 24 which houses the first luminous source 18 and into a second compartment 28 which houses the second luminous source 19.

The first compartment 24 and the second compartment 28 are separated by at least one separation wall 32. The separation wall is preferably opaque to the luminous beams produced by the luminous sources 16, 18, 19.

Advantageously, the lenticular body 20 comprises a first transmission portion 40, facing the first compartment 24 that transmits, at least partially, the first luminous beam towards the outside.

The lenticular body 20 comprises a second transmission portion 44 facing the second compartment 28 that transmits, at least partially, the second luminous beam towards the outside.

The lenticular body 20 further comprises an opaque portion 48, interposed between the first transmission portion 40 and second transmission portion 44, so as to conceal the view of the first and the second luminous sources 16, 18, 19 from the outside.

According to an embodiment, the first transmission portion 40 and/or the second transmission portion 44 are transparent, semitransparent or translucent or opaline portions.

Preferably, the first luminous source 18 and second luminous source 19 are associated with opposite faces of the same printed circuit 52.

It should be noted that the distinction between the first and second luminous source, and therefore between the first and second compartment, is purely indicative: the first luminous source 18 may be positioned both above as well as below the second luminous source. The same applies, of course, to the first and second compartments.

According to an embodiment, the printed circuit 52 is positioned near the separation wall 32, between the first compartment 24 and the second compartment 28.

According to an embodiment, the printed circuit 52 itself forms, at least partially, the separation wall 32.

The opaque portion 48 faces the printed circuit 52 and/or the separation wall, so as to conceal the view of the printed circuit 52, of the separation wall 32 and/or of the luminous sources 16, 18, 19 from the outside.

According to a possible embodiment, a light guide 56, which transmits the first luminous beam towards the first transmission portion 40, is associated with the first luminous source 18.

More in detail, in an embodiment, the light guide 56 comprises a light inlet wall 60 substantially perpendicular to a first prevalent emission direction X'-X' of the first luminous beam. Furthermore, the light guide 56 comprises a reflection wall 64 which deflects the first luminous beam in a first prevalent propagation direction Y'-Y' perpendicular to the first prevalent emission direction X'-X' and to the first transmission portion 40.

In this embodiment, the first transmission portion 40 is made of a transparent material.

According to a possible embodiment, at least one reflector 68, which reflects the second luminous beam towards the second transmission portion 44, faces the second luminous source 19.

The reflector 68 receiving the second luminous beam in a second prevalent emission direction X"-X" and deflects it in a second prevalent propagation direction Y"-Y" substantially perpendicular to the second transmission portion 44.

In this embodiment, the second transmission portion 44 is made of an opaline material, which may, for example, be co-molded with the first transmission portion 40.

In one embodiment, the reflector 68 at least partially forms said separation wall 32.

Figure 4:
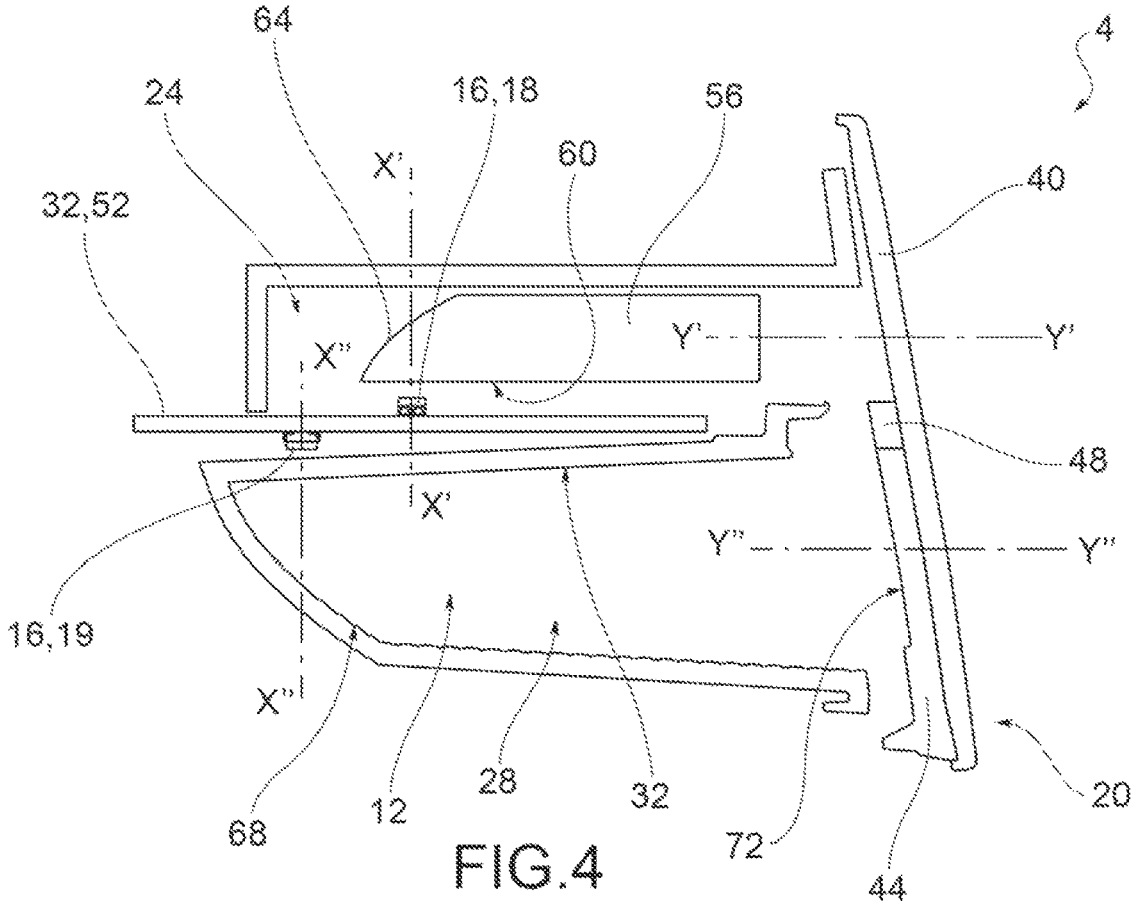
FIG. 4 shows a sectional view, in an assembled configuration, of the lighting and/or signaling device of FIG. 3.
Figure 3:
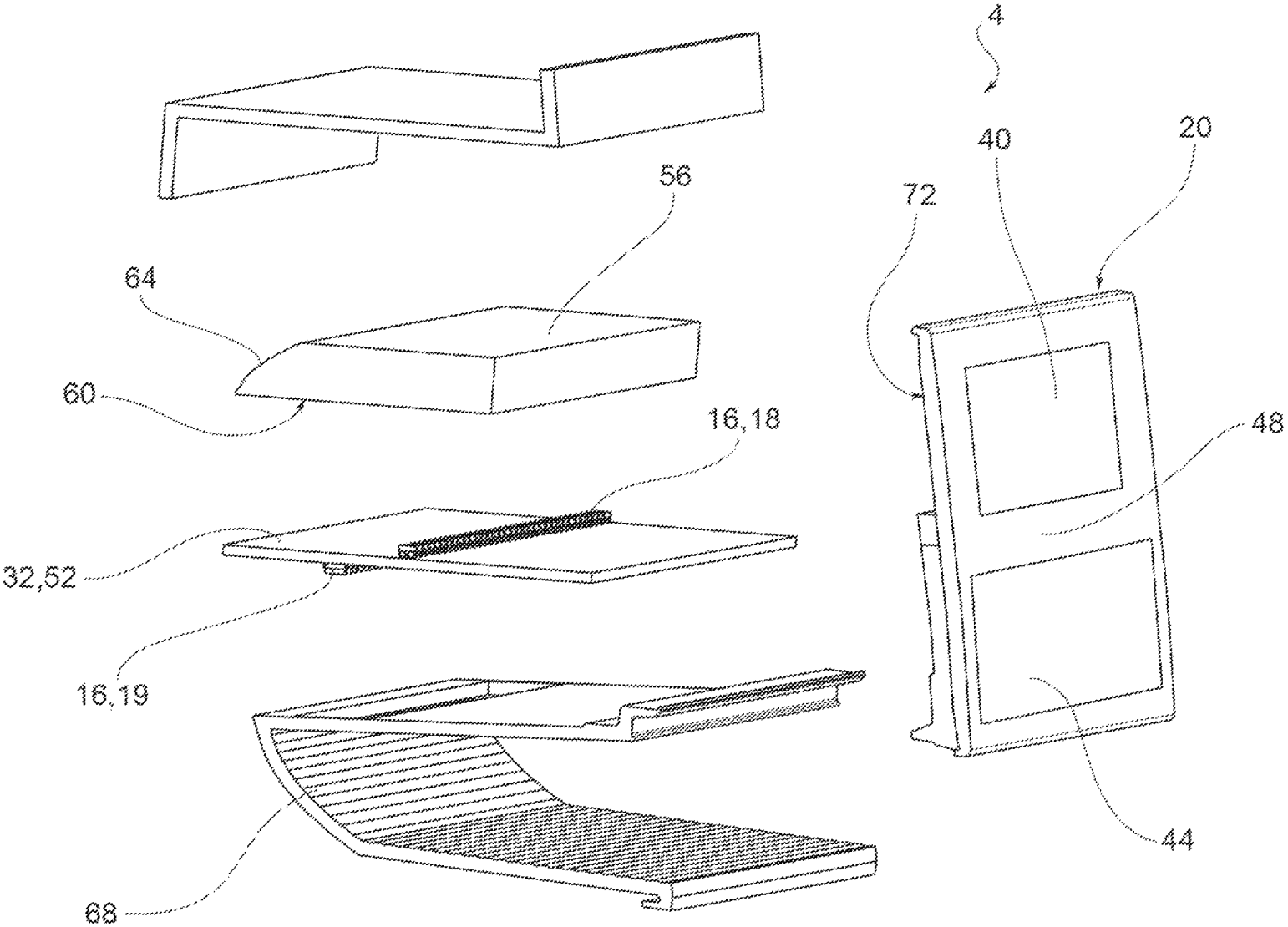
FIG. 3 shows a perspective view, with separate parts, of a lighting and/or signaling device according to a further embodiment of the present invention.

According to an embodiment (FIGS. 3-4), the lenticular body 20 comprises a first transmission portion 40 which extends to close the first compartment 24 and the second compartment 28, in which the second transmission portion 44 is opaline. Furthermore, the opaline second transmission portion 44 and the opaque portion 48 are associated (for example, co-molded) with the first transmission portion 40 on an internal side 72 of the lenticular body 20 facing the first compartment 24 and the second compartment 28. In other words, the opaline second transmission portion 44 and the opaque portion 48 are positioned so as to be facing the container body 8.

As it may be appreciated from the foregoing, the present invention allows to overcome the drawbacks presented in the background art.

In particular, the automotive lighting and/or signaling device in accordance with the present invention allows to use a single lens or an external lenticular body to diffuse/homogenize/mask the light and/or the luminous sources contained inside the container body of the lighting device, unlike the known solutions which provide for the use of multiple devices for diffusing and/or masking the light and the luminous sources.

Thereby, benefits are obtained in terms of assembly, costs and size of the lighting device. In fact, it is possible to realize and assemble a single lenticular body which carries out said functions at once.

Reducing the overall number of components reduces not only assembly times and costs, but also the weight and the size of the final assembly.

In order to meet contingent and specific needs, several changes and variations to the lighting and/or signaling devices described above may be introduced by those skilled in the art without departing from the scope of the invention as defined by the following claims. Thus, the invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A lighting and/or signaling device comprising:

a container body which delimits a containment seat closed by a lenticular body, said containment seat housing a first luminous source adapted to emit a first luminous beam, and a second luminous source adapted to emit a second luminous beam, said containment seat being closed by a lenticular body adapted to be at least partially crossed by the luminous beams produced by said luminous sources, so as to transmit said luminous beams outside of the containment seat, wherein the containment seat is divided into a first compartment which houses the first luminous source and a second compartment which houses the second luminous source, said first compartment and second compartment being separated by at least one separation wall, wherein the lenticular body comprises:

a first transmission portion, facing the first compartment that transmits, at least partially, the first luminous beam towards the outside, a second transmission portion, facing the second compartment that transmits, at least partially, the second luminous beam towards the outside, wherein the first transmission portion and the second transmission portion have different transmission properties and the first transmission portion and the second transmission portion are one piece; and an opaque portion, interposed between said first transmission portion and second transmission portion, so as to conceal the view of said first luminous source and second luminous source from the outside.

2. The lighting and/or signaling device as set forth in claim 1, wherein the first transmission portion and/or the second transmission portion are transparent, semitransparent or translucent or opaline portions.

3. The lighting and/or signaling device as set forth in claim 1, wherein said first luminous source and second luminous source are associated with opposite faces of a same printed circuit.

4. The lighting and/or signaling device as set forth in claim 3, wherein said printed circuit is positioned near said separation wall between the first compartment and the second compartment.

5. The lighting and/or signaling device as set forth in claim 3, wherein said printed circuit itself forms, at least partially, said separation wall.

6. The lighting and/or signaling device as set forth in claim 3, wherein the opaque portion faces the printed circuit and/or the separation wall, so as to conceal the view of the printed circuit, of the separation wall and/or of the luminous sources from the outside.

7. The lighting and/or signaling device as set forth in claim 1, wherein a light guide, which transmits the first luminous beam towards the first transmission portion, is associated with the first luminous source.

8. The lighting and/or signaling device as set forth in claim 7, wherein said light guide comprises a light inlet wall substantially perpendicular to a first prevalent emission direction (X'-X') of the first luminous beam, a reflection wall which deflects the first luminous beam in a first prevalent propagation direction (Y'-Y') perpendicular to the first prevalent emission direction (X'-X') and to the first transmission portion.

9. The lighting and/or signaling device as set forth in claim 8, wherein said first transmission portion is transparent.

10. The lighting and/or signaling device as set forth in claim 1, wherein at least one reflector, which reflects the second luminous beam towards the second transmission portion, faces the second luminous source.

11. The lighting and/or signaling device as set forth in claim 10, wherein the reflector receives the second luminous beam in a second prevalent emission direction (X"-X") and deflects it in a second prevalent propagation direction (Y"-Y") substantially perpendicular to the second transmission portion.

12. The lighting and/or signaling device as set forth in claim 11, wherein said second transmission portion is opaline.

13. The lighting and/or signaling device as set forth in claim 10, wherein said reflector at least partially forms said separation wall between the first compartment and the second compartment.

14. The lighting and/or signaling device as set forth in claim 1, wherein the lenticular body comprises a first transmission portion, which extends to close the first compartment and the second compartment, wherein the second transmission portion is opaline, and wherein the opaline second transmission portion and the opaque portion are associated with the first transmission portion on an internal side of the lenticular body facing said first compartment and second compartment.

15. The lighting and/or signaling device as set forth in claim 14, wherein the second transmission portion and/or the opaque portion are co-molded with the first transmission portion.

16. The lighting and/or signaling device as set forth in claim 1, wherein said first luminous source and/or second luminous source are LED or laser luminous sources.

* * * * *